United States Patent [19]

Crosman et al.

[11] 4,031,657

[45] June 28, 1977

[54] ACTION FIGURE

[75] Inventors: Dorland L. Crosman, Glen Ridge, N.J.; Charles M. Diker, New York, N.Y.

[73] Assignee: Aurora Products Corporation, New York, N.Y.

[22] Filed: Feb. 5, 1976

[21] Appl. No.: 655,564

[52] U.S. Cl. ..... 46/142; 46/148

[51] Int. Cl.[2] ..... A63H 13/06

[58] Field of Search ..... 46/119, 120, 142, 148, 46/150

[56] References Cited

UNITED STATES PATENTS

| | | | |
|---|---|---|---|
| 3,703,048 | 11/1972 | Cooper | 46/148 |
| 3,845,956 | 11/1974 | Goldfarb et al. | 46/142 X |
| 3,856,304 | 12/1974 | Matsumoto et al. | 46/142 |
| 3,864,870 | 2/1975 | Breslow et al. | 46/148 |
| 3,906,661 | 9/1975 | Weiser | 46/119 |

*Primary Examiner*—Russell R. Kinsey

*Assistant Examiner*—Robert F. Cutting

*Attorney, Agent, or Firm*—Amster & Rothstein

[57] ABSTRACT

A human-like figure actuable by an operator to simulate the movements of a human being. The figure is mounted near the front of a platform by means of one of its legs and is operated by means of a set of controls near the rear of the platform to move a pair of articulated arms and the second leg. The control arrangement near the rear of the platform includes a handle which extends laterally on each side of the platform and can be held by the operator to maneuver the platform. The controls are arranged on either side of the handle so that the operator can work any one of them with his fingers without releasing the others. By working a single control the operator can make the figure kick its second leg and bend at the waist to simulate a karate kick. Two additional controls each operate one of the figure's arms, one of which can be made to simulate a punch and the other to simulate a karate chop.

20 Claims, 6 Drawing Figures

ACTION FIGURE

This invention relates generally to animated figures and in particular to human-like figures which can be controlled by an operator to simulate movements of a human being.

Figures are available in the prior art which attempt to simulate movements of a human being. For example, U.S. Pat. No. 3,425,154 issued to K.W. Lindsay, et al., discloses a walking doll powered by an electric motor. The doll includes a body which is mounted for rocking movement on a pair of legs and each of the legs is arranged to pivot with respect to the body. The motor is coupled to the body and the legs through separate cam and follower arrangements which shift the center of weight of the body from side to side and impart a mechanical stepwise force to the legs in coordinated relation to the weight shift. As a result, the doll shuffles along a surface on which it is placed in the manner of a toddler learning to walk. This doll does not simulate the movements of a human being other than a toddler and, in particular, does not simulate athletic movements. Furthermore, the walking movement of the doll can not be controlled by an operator. Also, the complex walking mechanism occupies most of the space inside the doll body and makes it difficult, if not possible, to incorporate additional mechanisms, such as those for actuating arms, inside a figure which includes the walking mechanisms.

Throughout the years animated figures have also been available which are controlled by an operator to simulate human movements. A popular application for such figures has been to boxing games in which competitors operate animated figures in a simulated boxing match. In a typical boxing game, each competitor is provided with a figure having articulated arms, which figure is mounted near the front of a platform, and is operated by means of controls near the rear of the platform to simulate a boxer's punching movements. However, other than the punching movements, and a simulated sagging movement achieved by bending stationary legs at the knees, the figure's movements have been achieved by moving the platform itself.

Although animated figures do exist which are controllable to simulate boxing movements of a human being, these figures do not possess certain characteristics desirable in figures capable of simulating general movements and movements in other competitive sports, such as karate. For example, the figures are not able to bend at the waist in order to dodge a blow delivered by an opponent or when performing a kicking movement, in order to realistically simulate a karate kick. Furthermore, these prior art figures cannot be made to perform a realistic karate chop (or a ball throwing motion), which requires that the figure have an articulated arm which is normally flexed and is capable of moving forward and downward from an overhead position while straightening from its flexed condition. Each additional movement normally requires an additional control which must be conveniently operated by the operator. It would be desirable to produce certain combined movements, such as kicking and body bending, by operating a single control. To lend realism and excitement to a karate match, it is desirable that the figures be capable of a quick and immediate response to an opponent's moves. Moreover, a figure of the type described should meet the overall objectives of ruggedness of construction and reliability of operation under repeated use.

Broadly, it is an object of the present invention to provide a human-like figure controllable by an operator to simulate human movements, which figure overcomes one or more of the problems in the prior art. Specifically, it is within the contemplation of the present invention to provide such a figure which can be made to bend at the waist.

It is a further object of the present invention to provide a human-like figure, controllable by an operator to bend at the waist while kicking its leg.

It is a specific object of this invention to provide a human-like figure controllable by an operator to simulate karate fighting movements of a human being.

It is another object of this invention to provide a human-like figure which can be operated, by means of a single control, to bend at the waist while kicking its leg.

It is yet another object of this invention to provide a figure with articulated arms which can be controlled by an operator to simulate the karate chopping motion of a human being, by rotating its arm forward and downward from an overhead position while straightening its arm from a flexed position.

It is a further object of this invention to provide a control arrangement for operating a human-like figure to simulate movements of a human being in which an operator can achieve movement of the figure by working any control without releasing any other control, so that time is not lost in moving between controls;

It is yet another object of this invention to provide a human-like figure controllable by an operator to simulate the movements of a human being, which figure satisfies the practical requirements for such a device including ruggedness of construction and reliability of operation under repeated use.

In accordance with one aspect of the invention, a figure is provided which is operated by means of a single control to perform a combined kick and body bend, in simulation of a karate kick. The figure has a body which is supported for pivotal movement about a first axis and has at least one leg mounted to the body for rotational movement about a second axis. A control is coupled to the leg mounting and, when operated, imparts a force to it which produces rotation and displacement of the leg. The rotation of the leg produces a kicking movement and the displacement imparts pivotal movement to the body to produce body bending.

In accordance with an illustrative embodiment demonstrating objects and features of the present invention, there is provided a figure controllable by an operator to simulate karate fighting movements of a human being. The figure includes a head, a body, a pair of articulated arms depending from either side of the body, and a pair of legs depending from either side of the body. The figure is mounted by means of a stationary first leg, near the front end of a platform in a generally upright position, and a set of controls near the rear of the platform is used to operate the figure. The body is mounted for pivotal movement with respect to the stationary leg and the second leg is secured to a first end of a shaft which is journaled in the body. The second end of the shaft is coupled to the controls so that the operation of a single control causes the shaft to rotate in the body and to be displaced so that the body pivots with respect to the stationary leg. The rotation of the shaft causes kicking of the leg and the displacement of the shaft produces bending of the figure from its waist. In addition, the figure's arms are arranged to rotate with respect to the body and simultaneously to straighten or bend. The arms, which are mounted on shafts journaled in the body at the shoulders, are jointed at the elbows, and are normally in a flexed condition at the side of the body. Each arm includes an internal rod which is pivotally mounted to a point on the body close to the arm shaft but eccentric thereto, which rod is also pivotally joined to a point on the forearm near, but eccentric to, the fulcrum of the elbow joint. By this arrangement, when an arm is rotated first downward and backward and then through an arc which terminates in front of the figure, the arm is progressively straightened from its flexed condition as it reaches the front of the figure and simulates a karate chop movement. The control arrangement is constructed to provide quick and immediate response of the figure to the operator. A handle is provided near the rear of the platform which extends laterally on each side of the platform. A leg control member is provided at the rearward side of the handle, which control member is moved toward the handle to operate the movable leg, and a pair of arm control members are provided at the other side of the handle and on opposite sides of the leg control member, which arm control members are moved toward the handle to operate the arms. By means of this arrangement, the operator can grasp the handles from the rear of the platform so as readily to maneuver the platform, and can operate the leg control member with his thumbs and the arm control members with the fingers of each hand. Clearly, any control member can be operated without releasing the others.

The foregoing brief description, as well as further objects, features and advantages of the present invention will be more fully understood by reference to the following detailed description of a presently preferred, but nonetheless illustrative, embodiment in accordance with the present invention when taken in conjunction with the accompanying drawings wherein.

Figure 1:
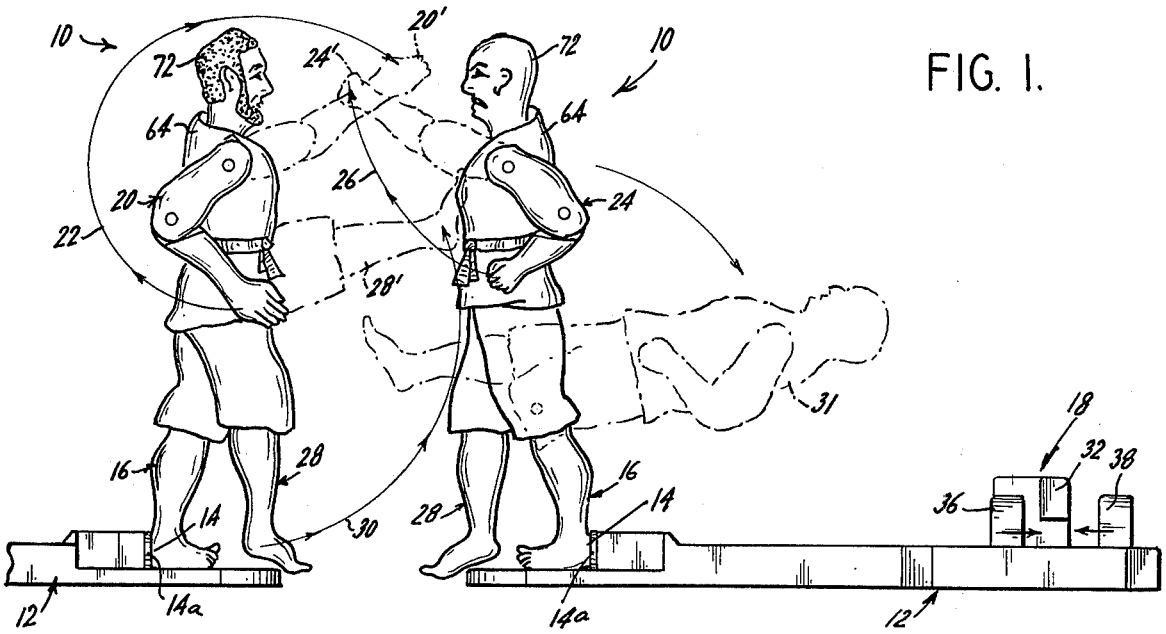
FIG. 1 is a side elevational view showing two figures according to the illustrative embodiment of the invention engaged in a karate fight and indicating movement of the various parts of the figures, as well as the manner of use thereof.

Referring to FIG. 1, there is shown a pair of karate fighting figures 10, 10 which are normally employed together and are operated by competitors in a karate match. The figures 10,10 each have a head 72, a body 64, a pair of articulated arms 20, 24 mounted at the sides of the body, and are identical except for the appearance of their heads. Each competitor is provided with a figure 10 mounted in a generally upright near the front of a platform 12 by means of the heel 14 of its left foot 16, and each competitor operates his figure to simulate a karate fight.

Figure 2:
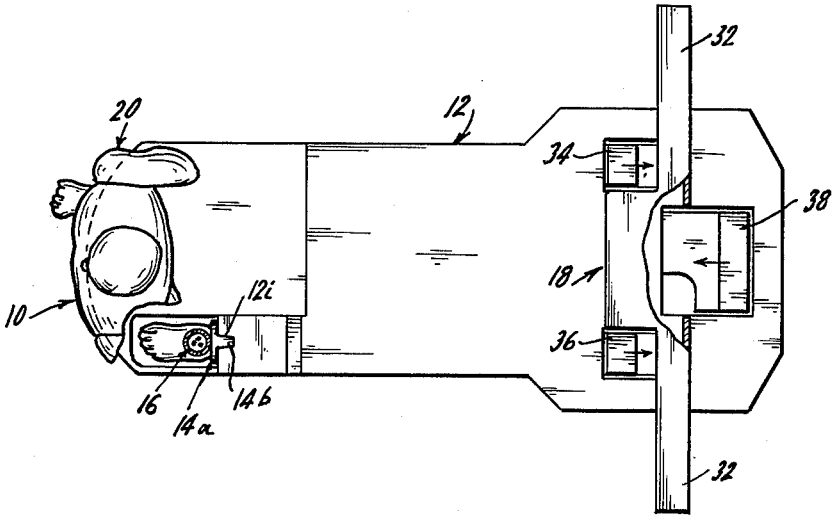
FIG. 2 is a top view with parts broken away, and partially in section showing the arrangement of a figure when mounted on its platform, and the details of the control arrangement.

By operating a set of controls 18 located near the rear of the platform 12, each competitor can make his figure achieve any one or a combination of human-like karate movements. This control arrangement 18 includes control members 34, 36, 38 (see FIG. 2) which operate right arm 20, left arm 24 and right leg 28 respectively. When control member 34 is moved in the direction indicated by its arrow (FIG. 2), articulated right arm 20 rotates downward and rearward at the shoulder, while straightening at the elbow, and follows path 22 to deliver a roundhouse karate chop to the opponent (shown in phantom as 20' in FIG. 1). When control member 36 is moved in the direction of its arrow (FIG. 2), articulated left arm 24 rotates upward and forward at the shoulder, while simultaneously straightening at the elbow, and follows path 26 in FIG. 1, to deliver a punch (shown in phantom as 24') to the chest or face of the opponent, or to block a blow initiated by the opponent. The right leg 28 of each figure is mounted to rotate upward and foward with respect to the body, and can be operated to swing through path 30 to deliver a kick (shown in phantom as 28') to the opponent's chest or head, by moving control member 38 in the direction of its arrow (FIG. 2). In addition, when a kick is delivered, the figure bends to the left from its waist (shown in phantom in FIG. 4), in simulation of the action of a human being in delivering such a kick. This bending also permits the figure to dodge the opponent's blows. If either figure is hit in the front of its head or in the chest, it will fall backward as shown in phantom as 31 and the opponent scores a point. The match is resumed or a new match begun by raising the figure to its upright position. Thus, a realistic and exciting karate match is simulated between the two opponents.

The control arrangement 18, positioned near the rear end of platform 12 opposite the figure 10, permits exceptionally quick execution of the aforementioned movements, by letting the operator work each control without releasing any of the others. As best seen in FIG. 2, the control arrangement includes a handle 32 that extends laterally on either side of platform 12. Control member 38, for leg 28, is mounted for sliding movement in platform 12 on the rearward side of handle 32 and controls 34, 36 for arms 20, 24 respectively are mounted for sliding movement in platform 12 on the opposite side of handle 32 and on either side of control 38. In use, the platform 12 is placed on a flat surface. The operator holds each side of handle 32 in one of his hands with the figure 10 facing away from him, and is thereby readily able to move the platform 12 in order to out maneuver his opponent. Without releasing handle 32, he can press control 38 with his thumbs and the controls 34, 36 are readily operated by the first fingers of his right and left hands, respectively.

Figure 3:
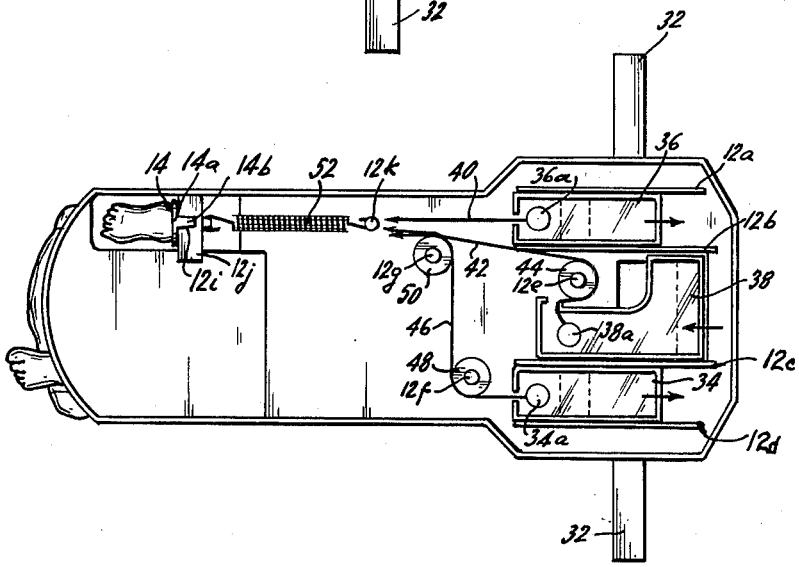
FIG. 3 is a bottom view of the figure and platform of FIG. 2, with the bottom cover removed, showing the details of construction of the control members and the manner of linking them to the figure, as well as the manner of mounting the figure to the platform.

As best seen in FIG. 3, platform 12, preferably made of plastic, includes parallel rails **12*a*, 12*b*, 12*c*, and 12*d*** on its undersurface, which rails serve to guide members 34, 36, 38 for sliding movement. Control member 36 is guided for sliding movement between rails 12*a* and 12*b*. A string 40 is secured to control member 36 at 36*a* and extends therefrom into FIG. 10 through heel 14 to a control mechanism, within the body, which operates arm 24. Thus, when a force is applied to control member 36 to move it in the direction of its arrow (in FIG. 3), this force is transmitted by string 40 to the control mechanism for arm 24. Control member 38 is guided for sliding movement between rails 12*b* and 12*c*. A string 42, which is secured to control member 38 at 38*a*, extends around a pulley 44, rotatably mounted on a shaft 12*e* extending below platform 12, and into FIG. 10 via heel 14 to an operating mechanism for leg 28. By means of string 42, the movement of control member 38 in the direction of the arrow is converted to an upward movement of right leg 28. Control member 34 is mounted for sliding movement between rails 12*c* and 12*d*. A string 46, which is joined to control member 34 at 34*a*, extends around a pulley 48 rotatably mounted on a shaft 12*f*, around another pulley 50 rotatably mounted on a shaft 12*g*, and into FIG. 10 via heel 14 to an operating mechanism for arm 20. By means of string 46, the movement of control member 34 in the direction of its arrow is coupled to figure 10, and is effective to operate right arm 20 thereof. A cover (13 in FIG. 5) is placed on the bottom of platform 12 to enclose and protect the operating mechanisms.

From the foregoing description it will be appreciated that, should it be desirable to control additional movements of FIG. 10, such as swiveling the figure with respect to the platform, additional control members for this purpose are easily provided while still permitting the operator to operate each control without releasing the others. For example, a pair of control members, each operated by one of the operator's thumbs, could be provided in place of the single control member 38; or a plurality of control members, each operated by the fingers of one of the operator's hands, could be provided in place of each of control members 34, 36.

To allow for some flexibility in mounting the FIG. 10 to platform 12, the heel 14 includes a generally cylindrical extension 14*a* which is received in the opening of a passageway 12*h* formed between the top of platform 12 and a cross-member 12*j* on the bottom thereof. To prevent sideways tilting of FIG. 10, extension 14*a* is formed with keys 14*b*, 14*b* which are received in keyways 12*i*, 12*i* formed in the top and bottom of passageway 12*h*. A spring 52, connected between extension 14*a* and the lug 12*k* in platform 12, provides the pressure to retain extension 14*a* in channel 12*h*. By means of the foregoing arrangement, FIG. 10 is held in a relatively stationary position under most conditions. However, should the operator apply a force to the FIG. 10, such as by leaning on it, the spring 52 will yield and will permit some movement of the FIG. 10 without breaking away heel 14 from platform 12, as would occur if the connection between the two were rigid.

Figure 4:
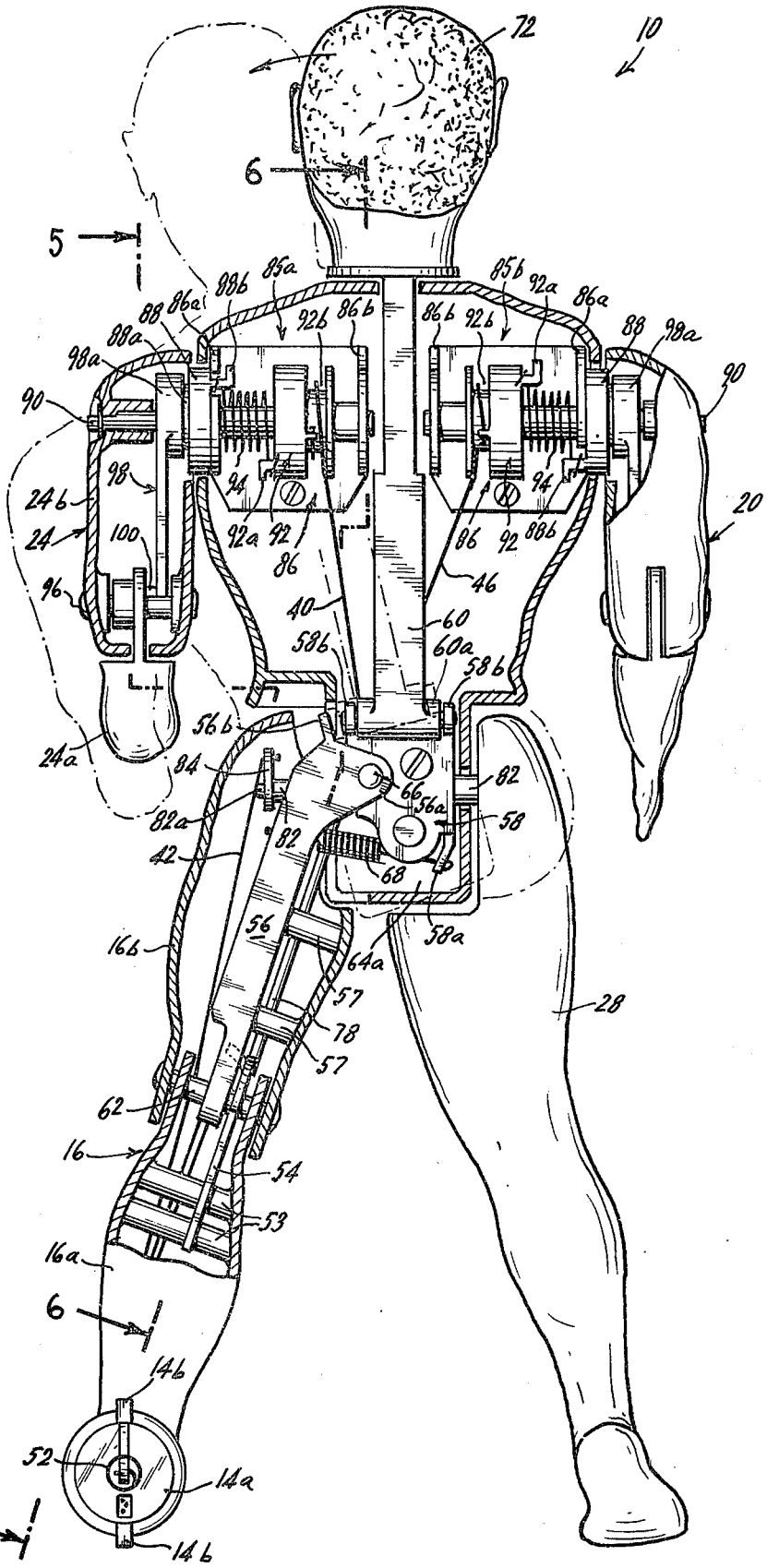
FIG. 4 is an enlarged rear view, with parts in section, of the karate fighting figure according to the invention, illustrating the details of internal construction.
Figure 5:
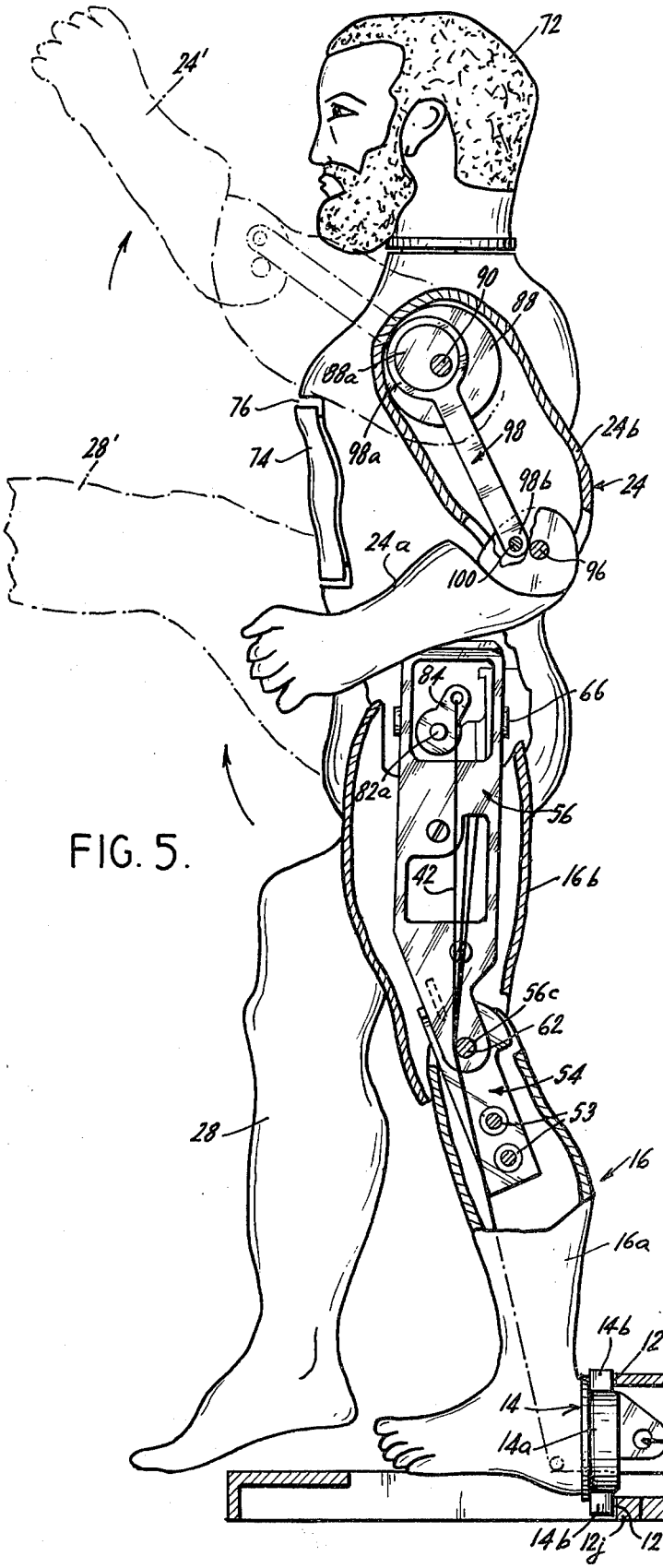
FIG. 5 is a side sectional view taken along contour 5—5 in FIG. 4, and illustrates further details of the internal construction of the arms and legs of the figure and of the platform.
Figure 6:
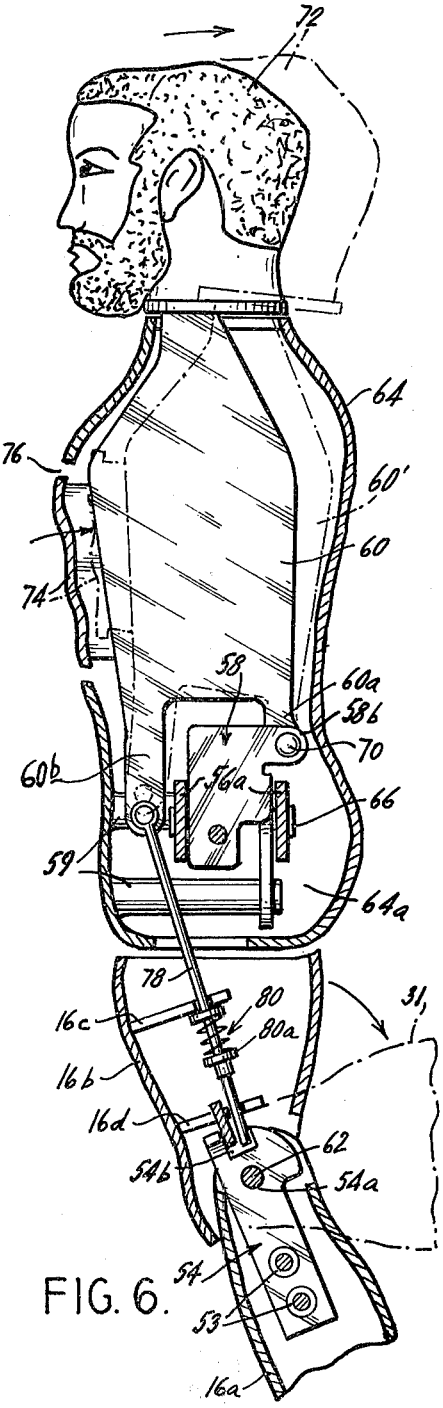
FIG. 6 is a broken-away side sectional view of the figure taken along contour 6—6 in FIG. 4, and illustrates the internal details of construction of the body of the figure and further details of construction of the legs.

Referring now to FIGS. 4 through 6, it will be observed that the internal super-structure of FIG. 10 broadly comprises a lower leg member 54, secured by leg braces 53, 53 inside lower leg portion 16*a;* an upper leg member 56 secured by braces 57, 57 inside thigh 16*b* and pivotally mounted to member 54 by means of a pin 62; a lower body member 58 secured by braces 59, 59 in body 64 and pivotally mounted to member 56 by means of a pin 66; and an upper body member 60 pivotally mounted to member 58 by means of a pin 70. The members 54, 56, 58, 60, as well as all other internal components of the FIG. 10, are housed within a tough plastic shell forming the outer skin of the figure.

The lower leg member 54 is securely fastened inside lower portion 16*a* of leg 16, which is anchored to platform 12 in a generally upright position, as previously explained. Lower leg member 54 also includes an aperture 54*a* through which pin 62 passes, and a detent 54*b* which will be discussed more fully below.

The upper leg member 56 is securely fastened inside the thigh portion 16*b* of leg 16 and extends throughout the length thereof. The lower part of member 56 has an aperture 56*c* (see FIG. 5) which permits member 56 to be pivoted on pin 62 which forms the pivotal axis of the knee joint of leg 16. As will be explained more fully below, members 54 and 56 are normally locked against pivotal motion about pin 62, and leg 16 serves to support FIG. 10 in a generally upright position. Upper leg member 56 extends upwardly within thigh portion 16*b* and partly into a compartment 64*a* formed at the bottom of body 64, in which compartment lower body member 58 is securely fastened. Ears 56*a*, 56*a* of member 56 extend in front of and behind member 58 (see FIG. 6), respectively, and a pin 66 is connected through apertures in ears 56*a*, 56*a*, and is journaled in member 58 to pivotally join member 58 to member 56. An upward extension 56*b* on member 56 (see FIG. 4) limits the degree to which member 58 can pivot to the left with respect to member 56, and a spring 68 connected between member 56 and downward extension 58*a* of member 58 produces a force which tends to restore member 58 to the unpivoted position.

The figure is arranged so that a blow to the head or chest causes the figure to pivot backwards about pin 62 to position 31 (see FIGS. 1 and 6). Member 58 includes rearward extensions 58*b*, 58*b* which are disposed on either side of downward extension 60*a* of member 60 (See FIGS. 4 and 6). A pin 70 is connected to extensions 58*b*, 58*b* and is journaled inside extension 60*a* to pivotally mount member 60 to member 58. From pin 70, member 60 extends upward inside body 64. The head 72 of figure 10 is secured at the top of member 60, and a chest plate 74, mounted in an opening 76 in the chest area of FIG. 10, is secured to the front of member 60. Member 60 also includes an extension 60*b* which depends from member 60 and is disposed in front of member 58 (See FIG. 6). A rod 78, which is pivotally mounted at the bottom of extension 60*b*, extends downward through guides 16*c* and 16*d* which are formed in thigh portion 16*b* of leg 16 and is retained in the guides by member 56 which is mounted in thigh portion 16*b*. The lower end of rod 78 is retained in dentent 54*b* of lower leg member 54 by means of a spring loading mechanism 80 which is coaxially secured to rod 78 by retainer 80*a*. The extension of rod 78 into detent 54*b* locks the knee joint of leg 16 and prevents FIG. 10 from pivoting backwards around pin 62. However, when a force is applied to the front of head 72 or to chestplate 74 which is sufficient to overcome the force of spring-loading arrangement 80, member 60 pivots backwards to the position indicated in phantom as 60′ in FIG. 6 with the result that rod 78 is withdrawn from detent 54*b* and FIG. 10 falls backwards.

Right leg 28 is formed as a single solid member and includes near its top, a leg shaft 82 which extends laterally through compartment 64*a* of body 64, is journaled in lower body member 58, and emerges within thigh portion 16*b* of leg 16 (See FIG. 4). A lever arm 84, which is secured contiguous to free end 82*a* of leg shaft 82 receives the end of string 42. From the foregoing description, it will be appreciated that when a force is applied to string 42 by operating control member 38, this force is transmitted to lever arm 84 and rotates leg shaft 82 in a clockwise direction (FIG. 5) and simultaneously pulls end 82*a* downward. The rotation of shaft 82 raises leg 28 upward to simulate a kick and the downward movement of end 82*a* pivots member 58 about pin 66 to simulate FIG. 10 bending from the waist. When the control member 38 is released, leg 28 drops of its own weight and the body 64 is restored to its upright position by means of spring 68.

The figure includes a pair of articulated arms which are capable of compound movements. Each of the arms 20, 24 is rotated about the shoulders of the figure by means of arm rotating mechanisms 85*a*, 86*b* secured inside body 64 on either side of member 60. Arm rotating mechanisms 85*a*, 85*b* are identical except that they rotate arms 20, 24 in opposite directions. In addition, each of arms 20, 24 is pivoted at the elbow and has an internal construction including a connecting rod 98, which causes the arms to be in a normally flexed condition at the side of the body, but straightens them when they are rotated. Arms 20, 24 have identical internal constructions.

Inasmuch as arm rotating mechanisms 85*a*, 85*b* are nearly identical, only mechanism 85*a*, corresponding to arm 24, will be discussed in detail. Mechanism 85*a*, has a bracket 86 which includes a pair of parallel walls 86*a*, 86*b*, securely mounted inside the upper portion of body 64. A bearing 88, preferably made of nylon and having an accentric journal portion 88*a* thereon is mounted on wall 86*a* and protrudes partially outside the body 64. Arm shaft 90 is secured near the top of arm 24 and extends laterally thereof into body 64. Arm shaft 90 is journaled in bearing 88 and wall 86*b*, and has a spool member 92 coaxially affixed to it between walls 86*a* and 86*b*. Also, spring 94, which is coaxially mounted with respect to shaft 90 and is retained between lugs 88*b* and 92*a* of bearing 88 and spool 92, respectively, resists rotation of shaft 90. Mechanisms 85*a*, 85*b* are identical except that the spring 94, 94 are wound to resist rotation in opposite directions. String 40, which is received in the channel 92*b* formed in spool 92 of mechanism 85*a* wound over and around spool 92 and is secured thereto (see FIG. 4). Similarly, string 46 is received in a channel 92*b* formed in the spool 92 of mechanism 85*b*, but is wound in the opposite direction to string 40, that is, string 46 is wound under and around its spool 92 and is secured thereto (See FIG. 4).

From the foregoing description it will be appreciated that when a force sufficient to overcome the resistance of spring 94, is applied to string 42 the string will be unwound from spool 92, and the shaft 90 will be rotated so as to rotate arm 24 upward and towards the front of the FIG. 10 to deliver a punch. Similarly, when control member 34 is operated to apply a force to string 46, string 46 is unwound from spool 92 and arm 20 is rotated downward and rearward and continues over the head of FIG. 10 to deliver a karate chop. When either of levers 36, 38 is released, the corresponding arm is returned by the action of its corresponding spring 94 to its normal rest position at the side body 64, as indicated in FIG. 4.

The internal structures of arms 20, 24 which cause them to straighten while rotating are identical. Therefore, only arm 24 will be described in detail. Arm 24 includes a forearm portion 24*a* and an upper arm portion 24*b*. Upper arm 24*b* is secured to arm shaft 90 which is journaled in stationary bearing 88, and when the arm shaft 90 rotates as explained above, upper arm 24*b* rotates with it. Pin 96 is secured through upper arm 24*b* in the vicinity of the elbow, and forearm 24*a* is pivotally mounted on pin 96 to form an elbow joint. Connecting rod 98 has a ring-shaped top 98*a* which is adapted to mount rotatably over eccentric journal 88*a* of bearing 88, and to be held in that position when the arm 24 is assembled to the body 64, as best seen in FIG. 4. The lower end 98*b* of connecting rod 98 is pivotally joined to forearm 24*a* by means of a pin 100 secured in forearm 24*a* in close proximity to pin 96.

From the foregoing description, it will be appreciated that, as arm shaft 90 rotates clockwise (see FIG. 5) and carries upper arm 24*b* with it, connecting rod 98 is rotated about the journal 88*a*. Inasmuch as journal 88*a* is eccentric with respect to the bearing 88 and axle 90, pin 100 is progressively moved further from arm shaft 90 as connecting rod 98 rotates (See FIG. 5). However, the distance between arm shaft 90 and pin 96 remains constant, so the movement of pin 100 away from arm shaft 90 causes forearm 24*a* to pivot counterclockwise about pin 96, with the result that arm 24 is ultimately straightened (shown as 24' in FIG. 5). Arm 20 is identical to arm 24 except that its arm shaft 90 rotates in the opposite direction, so that arm 20 rotates behind the FIG. 10, over it heads, and is straightened as it is brought forward and downward to simulate a karate chop.

Although a specific embodiment of the invention has been described for illustrative purposes, it will be appreciated by one skilled in the art that many modifications, additions and substitutions are possible without departing from the scope and spirit of the invention. For example, the figure could be provided with two movable legs. It will also be appreciated that the principles of the invention could equally well be applied to figures for performing other than karate movements, such as football playing figures (i.e. kicking and throwing a ball) or or dancing figures.

What is claimed is:

1. In a human-like figure actuable to simulate various movements of the human being; said figure including a head, a body, a pair of arms depending from opposite sides of said body, and a pair of legs depending from opposite sides of said body; at least one means for moving a leg and simultaneously producing movement of the body of said figure comprising:

body mounting means for supporting said body for movement about a first axis;

leg mounting means for moving said leg relative to said body about a second axis; and motion-transmitting means coupled to said leg mounting means and responsive to an applied force for rotating said leg about the second axis and displacing said leg with respect to said body mounting means, and simultaneously pivoting said body about the first axis to simulate the movement of a human being.

2. The figure according to claim 1 wherein said leg mounting means includes a leg mounting shaft having a first end fixed to the leg to be moved and extending therefrom into said body, past the first axis, and terminating in a second end, said leg mounting shaft being journaled in said body, said motion-transmitting means being coupled to said leg mounting shaft between the second end thereof and the first axis.

3. The figure of claim 2 wherein said motion-transmitting means further includes an actuating arm having a first end affixed contiguous to the second end of said leg mounting shaft, the second end of said actuating arm being coupled to receive said applied force so that said actuating arm responds to said applied force by rotating said leg shaft and displacing the second end of said leg shaft.

4. The figure of claim 1 wherein said body mounting means is one of the legs of said figure.

5. In a figure according to claim 1 wherein at least one of said arms is articulated and includes an upper arm and a forearm pivotally joined to said upper arm, said at least one articulated arm being normally flexed and positioned at the side of said body, at least one means for actuating one of said at least one articulated arm comprising:

means mounting the arm to be actuated for rotational movement with respect to said body;

means for straightening and flexing said arm when said arm is rotated, said arm straightening and flexing means having a first end pivotally mounted to said body at a point proximate to the axis of rotation of said arm about said body, the second end of said arm straightening and flexing means being pivotally joined to said forearm at a point proximate to the forearm's pivot on said upper arm; and means coupled to said arm mounting means and responsive to an applied force for rotating said arm with respect to said body.

6. The figure according to claim 5 wherein said arm mounting means includes arm shaft means having one end affixed to the upper arm of said arm to be actuated and extending therefrom into said body, said arm shaft means being journaled in said body and being coupled to rotate in response to the applied force, thereby rotating said arm with respect to said body.

7. The figure according to claim 6 wherein said applied force is coupled to said arm shaft means through string-like means wrapped around said arm shaft means and having a first end affixed thereto, said force being applied to the second end of said string-like means so that said string-like means is unwrapped from said arm shaft means, thereby rotating said arm shaft means.

8. In combination with a figure according to claim 5 an elongated platform having first and second ends, said means for supporting said body being secured near the first end of said platform, a control arrangement proximate to the second end of said platform comprising:

a handle on said platform extending laterally of said platform on either side thereof;

at least one first control member movably mounted to said platform between said handle and said second end;

at least one second control member movably mounted to said platform between said handle and said first end; and means for coupling each of said at least one first control member and at least one second control member to a different one of said means for rotating and displacing said motion-transmitting leg shaft and said means for rotating said arm, so that said figure can be controlled by an operator to simulate movements of a human being when the operator holds said handle in his hands and operates said at least one first control member and said at least one second control member with his fingers.

9. The figure of claim 5 wherein said body has at least one opening therein and said body supporting means includes upper and lower sections pivotally joined to permit said figure to tip backward, said lower section having a detent at its top, said figure further comprising:

a generally vertical member mounted for pivotal movement inside said body and including means protruding through said at least one body opening, said head being fixed at the top of said vertical member;

a locking rod slidably mounted in the upper section of said supporting means protruding into the detent in said lower section to prevent said sections from pivoting at their joint; and means coupling said locking rod to said vertical member to withdraw said locking rod from said detent when said vertical member is pivoted in said body, so that the application of a force to said head or to said vertical member protruding means causes said locking rod to be withdrawn from said detent, whereby said figure falls backwards, in reaction to said force, by pivoting along the joint between said supporting means sections.

10. The figure of claim 9 further comprising means including resilient means for holding said locking rod in the detent in said lower leg section.

11. In combination with a figure according to claim 9 an elongated platform having first and second ends, said means for supporting said body being secured near the first end of said platform, a control arrangement proximate to the second end of said platform comprising:

a handle on said platform extending laterally of said platform on either side thereof;

at least one first control member movably mounted to said platform between said handle and said second end;

at least one second control member movably mounted to said platform between said handle and said first end; and means for coupling each of said at least one first control member and at least one second control member to a different one of said motion-transmitting and said means for rotating said arm, so that said figure can be controlled by an operator to simulate movements of a human being when the operator holds said handle in his hands and operates said at least one first control member and said at least one second control member with his fingers.

12. The figure of claim 1 wherein said body has at least one opening therein and said body supporting means includes upper and lower sections pivotally joined to permit said figure to tip backwards said lower section having a detent at its top, said figure further comprising:

a generally vertical member mounted for pivotal movement inside said body and including means protruding through said at least one body opening, said head being fixed at the top of said vertical member;

a locking rod slidably mounted in the upper section of said supporting means and protruding into the detent in said lower section to prevent said sections from pivoting at their joint; and means coupling said locking rod to said vertical member to withdraw said locking rod from said detent when said vertical member is pivoted in said body, so that the application of a force to said head or to said vertical member protruding means causes said locking rod to be withdrawn from said detent, whereby said figure falls backwards, in reaction to said force, by pivoting along the joint between said supporting means sections.

13. In a human-like figure actuable to simulate the movements of a human being, said figure including a head, a body, and a pair of arms depending from opposite sides of said body, at least one of said arms being articulated and including an upper arm and a forearm pivotally joined to said upper arm, said at least one articulated arm being normally flexed and positioned at the side of said body, at least one means for actuating one of said at least one articulated arm comprising:

arm-mounting means adapted to be actuated for rotational movement with respect to said body;

means for straightening and flexing said arm when said arm is rotated, said arm straightening and flexing means having a first end pivotally mounted to said body at a point proximate to the axis of rotation of said arm about said body, the second end of said arm straightening and flexing means being pivotally joined to said forearm at a point proximate to the forearm's pivot on said upper arm; and arm-rotation means coupled to said arm mounting means and responsive to an applied force for rotating said arm downward and backward with respect to said body, and through an arc terminating at the front of said body, said arm being straightened as it is brought towards the front of said body.

14. The figure according to claim 13 wherein said arm mounting means includes arm shaft means having one end affixed to the upper arm of said arm to be actuated and extending therefrom into said body, said arm shaft means being journaled in said body, and being coupled to rotate in response to the applied force, thereby rotating said arm with respect to said body.

15. The figure according to claim 14 wherein said applied force is coupled to said arm shaft means through string-like means wrapped around said arm shaft means and having a first end affixed thereto, said force being applied to the second end of said string-like means so that said string-like means is unwrapped from said arm shaft means, thereby rotating said arm shaft means.

16. In combination with a figure according to claim 13 an elongated platform having first and second ends, said figure being supported near the first end of said platform, a control arrangement proximate to the second end of said platform comprising:

a handle on said platform extending laterally of said platform on either side thereof;

at least one first control member movably mounted to said platform between said handle and said second end;

at least one second control member movably mounted to said platform between said handle and said first end; and means for coupling each of said at least one first control member and at least one second control member to a different one of said arm rotating means within said figure so that said figure can be controlled by an operator to simulate arm movements of a human being when the operator holds said handle in his hands and operates said at least one first control member and at least one second control member with his fingers.

17. The figure of claim 13 wherein said body has at least one opening therein and includes body supporting means having upper and lower section pivotally joined to permit said figure to tip backwards said lower section having a detent at its top, said figure further comprising:

a generally vertical member mounted for pivotal movement inside said body and including means protruding through said at least one body opening, said head being fixed at the top of said vertical member;

a locking rod slidably mounted in the upper section of said supporting means and protruding into the detent in said lower section to prevent said sections from pivoting at their joint; and means coupling said locking rod to said vertical member to withdraw said locking rod from said detent when said vertical member is pivoted in said body, so that the application of a force to said head or to said vertical member protruding means causes said locking rod to be withdrawn from said detent, whereby said figure falls backwards, in reaction to said force, by pivoting along the joint between said supporting means sections.

18. The figure of claim 17 further comprising means including resilient means for holding said locking rod in the detent in said lower leg section.

19. In combination with a figure according to claim 17 an elongated platform having first and second ends, said body supporting means being secured near the first end of said platform, a control arrangement proximate to the second end of said platform comprising:

a handle on said platform extending laterally of said platform on either side thereof;

at least one first control member movably mounted to said platform between said handle and said second end; and means for coupling each of said at least one first control member and at least one second control member to a different one of said arm rotating means within said figure so that said figure can be controlled by an operator to simulate arm movements of a human being when the operator holds said handle in his hands and operates said at least one first control member and at least one second control member with his fingers.

20. In combination with a figure according to claim 5, a platform having first and second ends, said means for supporting said body being secured near the first end of said platform, a control arrangement proximate to the second end of said platform comprising:

at least one handle;

a plurality of control member movably mounted to said platform proximate to said at least one handle; and means for coupling each of said plurality of control members to a different one of said motion-transmitting means and said means for rotating said arm, so that said figure can be controlled by an operator to simulate movements of a human being when the operator holds said at least one handle and operates said plurality of control members.

* * * * *